US009743166B2

(12) United States Patent
Abe et al.

(10) Patent No.: US 9,743,166 B2
(45) Date of Patent: Aug. 22, 2017

(54) DEVICE GENERATING SOUND

(71) Applicants: TOKIN CORPORATION, Sendai-shi, Miyagi (JP); SHARP KABUSHIKI KAISHA, Osaka-shi, Osaka (JP)

(72) Inventors: Yoshiyuki Abe, Sendai (JP); Katsunori Kumasaka, Sendai (JP); Kouichi Shuta, Sendai (JP); Osamu Yamazaki, Sendai (JP); Hiroshi Shima, Sendai (JP); Noriaki Ikezawa, Sendai (JP)

(73) Assignees: TOKIN CORPORATION, Sendai-Shi, Miyagi (JP); SHARP KABUSHIKI KAISHA, Osaka-Shi, Osaka (JP)

( * ) Notice: Subject to any disclaimer, the term of this patent is extended or adjusted under 35 U.S.C. 154(b) by 0 days.

(21) Appl. No.: 15/031,150

(22) PCT Filed: Oct. 21, 2014

(86) PCT No.: PCT/JP2014/077947
§ 371 (c)(1),
(2) Date: Apr. 21, 2016

(87) PCT Pub. No.: WO2015/064421
PCT Pub. Date: May 7, 2015

(65) Prior Publication Data

US 2016/0249120 A1 Aug. 25, 2016

(30) Foreign Application Priority Data

Oct. 28, 2013 (JP) ..... 2013-223431
Aug. 7, 2014 (JP) ..... 2014-161510

(51) Int. Cl.
*H04R 1/02* (2006.01)
*H04R 17/00* (2006.01)
(Continued)

(52) U.S. Cl.
CPC ..... *H04R 1/026* (2013.01); *H04R 7/045* (2013.01); *H04R 17/00* (2013.01); *H04R 17/005* (2013.01);
(Continued)

(58) Field of Classification Search
CPC H04R 7/045; H04R 2499/15; H04R 2440/01; H04R 1/026; H04R 17/00;
(Continued)

(56) References Cited

U.S. PATENT DOCUMENTS 7,382,079 B2 6/2008 Kawase et al.
9,066,183 B2 6/2015 Kano
(Continued)

FOREIGN PATENT DOCUMENTS

CN 1929700 B 8/2011
CN 102474691 A 5/2012
(Continued)

OTHER PUBLICATIONS

International Search Report (ISR) dated Dec. 2, 2014 issued in International Application No. PCT/JP2014/077947.
(Continued)

*Primary Examiner* — Davetta W Goins
*Assistant Examiner* — Oyesola C Ojo
(74) *Attorney, Agent, or Firm* — Holtz, Holtz & Volek PC

(57) ABSTRACT

In the present invention, a device is provided with a main surface member, a piezoelectric body plate, a first support part, and a housing. The main surface member is used as a vibration plate. The piezoelectric body plate vibrates according to an electric signal. The first support part supports the piezoelectric body plate. The housing has a second support part that supports the main surface member and extends in a prescribed direction that intersects the main surface member. The first support part is secured to the second support so
(Continued)

that the second support part vibrates in the prescribed direction according to the vibration of the piezoelectric body plate. The vibration of the piezoelectric body plate is transmitted to the main surface member via the first support part and the second support part, and due to this the main surface member vibrates to generate a sound.

15 Claims, 8 Drawing Sheets

(51) Int. Cl.
*H04R 7/04* (2006.01)
*H04R 31/00* (2006.01)

(52) U.S. Cl.
CPC ..... *H04R 31/006* (2013.01); *H04R 2440/05* (2013.01); *H04R 2499/11* (2013.01); *H04R 2499/15* (2013.01)

(58) Field of Classification Search
CPC H04R 17/005; H04R 31/006; H04R 2440/05; H04R 2499/11; G10K 2210/118; G06F 3/043
USPC ..... 381/152, 162
See application file for complete search history.

(56) References Cited

U.S. PATENT DOCUMENTS

| | | | | |
|---|---|---|---|---|
| 2003/0202672 | A1* | 10/2003 | Yamauchi | H04R 1/06 381/190 |
| 2008/0025533 | A1 | 1/2008 | Livingstone et al. | |
| 2015/0054382 | A1* | 2/2015 | Fujii | H01L 41/083 310/317 |
| 2015/0086047 | A1* | 3/2015 | Horii | H04R 7/045 381/151 |

FOREIGN PATENT DOCUMENTS

| | | | | | |
|---|---|---|---|---|---|
| JP | 10056498 | A | * | 2/1998 | H04B 1/38 |
| JP | 10285253 | A | * | 10/1998 | B06B 1/04 |
| JP | 2007208883 | A | | 8/2007 | |
| JP | 2008251669 | A | | 10/2008 | |
| JP | 2013150212 | A | | 8/2013 | |
| WO | 0221881 | A1 | | 3/2002 | |
| WO | 2005104614 | A1 | | 11/2005 | |

OTHER PUBLICATIONS

Taiwanese Office Action (and English translation thereof) dated Aug. 3, 2016, issued in counterpart Taiwanese Application No. 103137039.
Extended European Search Report (EESR) dated Apr. 10, 2017 issued in European counterpart Application No. 14857082.3.

* cited by examiner

DEVICE GENERATING SOUND

TECHNICAL FIELD

This invention relates to a device generating sound.

BACKGROUND ART

Patent Document 1 discloses an exciter in which a piezoelectric element is accommodated in a case. In Patent Document 1, the exciter is attached to a cowl of a motorcycle, for example. Vibration from the exciter is transmitted to the cowl and makes the cowl vibrate as a vibration plate to generate a sound. The piezoelectric vibration unit is attached to a panel of a mobile phone, for example, and makes the panel vibrate as a vibration panel to generate a sound.

PRIOR ART DOCUMENTS

Patent Document(s)

Patent Document 1: JPA2008-251669
Patent Document 2: JPA2007-208883

SUMMARY OF INVENTION

Technical Problem

In recent years, there is a demand to generate a sound by making a part of an electronic device vibrate as a vibration plate. However, it is hard to obtain sufficient sound pressure although the exciter of Patent Document 1 or the piezoelectric vibration unit of Patent Document 2 is assembled in an electronic device which is downsized and thinned.

It is therefore an object of the present invention to provide a structure capable of obtaining sufficient sound pressure even in an electronic device which is downsized and thinned.

Solution to Problem

One aspect of the present invention provides a device provided with a main surface member, a piezoelectric body plate, a first support part and a housing. The main surface member is used as a vibration plate. The piezoelectric body plate vibrates according to an electric signal. The first support part supports the piezoelectric body plate. The housing has a second support part that supports the main surface member and extends in a prescribed direction intersecting the main surface member. The first support part is secured to the second support part so that the second support part vibrates in the prescribed direction according to vibration of the piezoelectric body plate. The vibration of the piezoelectric body plate is transmitted to the main surface member via the first support part and the second support part, and due to this the main surface member vibrates to generate a sound.

Here, the device is an electronic device such as a mobile phone, a tablet or a PC. The main surface member is a glass plate forming a screen of the electric device, for example. The second support part is a side wall portion of the housing of the electric device or a portion supporting the glass plate.

Another aspect of the present invention provides a device provided with a main surface member, a piezoelectric body plate, a first support part and a housing. The main surface member is used as a vibration plate. The piezoelectric body plate vibrates according to an electric signal. The first support part supports the piezoelectric body plate. The housing is distinct and separated from the main surface member. The housing has a second support part that supports the main surface member and extends in a prescribed direction intersecting the main surface member. The first support part is secured to the second support part. Vibration of the piezoelectric body plate is transmitted to the main surface member via the first support part and the second support part, and due to this the main surface member vibrates to generate a sound.

Advantageous Effects of Invention

The second support part is a part of the housing and extends in the prescribed direction. Making the second support part vibrate at least in the prescribed direction makes the main surface member vibrate to generate a sound. According to this approach, sufficient sound pressure can be obtained in comparison with a case where the exciter or the piezoelectric vibration unit is attached to the main surface member.

Since the first support part supports the piezoelectric body plate and is secured to the second support part directly, it is unnecessary to provide separately a case for accommodating the piezoelectric body plate in the housing. In other words, it is unnecessary to reserve a large space for the piezoelectric body plate in the housing. Accordingly, even if the whole of the device is downsized and thinned, the structure generating a sound can be put in the housing.

An appreciation of the objectives of the present invention and a more complete understanding of its structure may be had by studying the following description of the preferred embodiment and by referring to the accompanying drawings.

DESCRIPTION OF EMBODIMENTS

Figure 1:
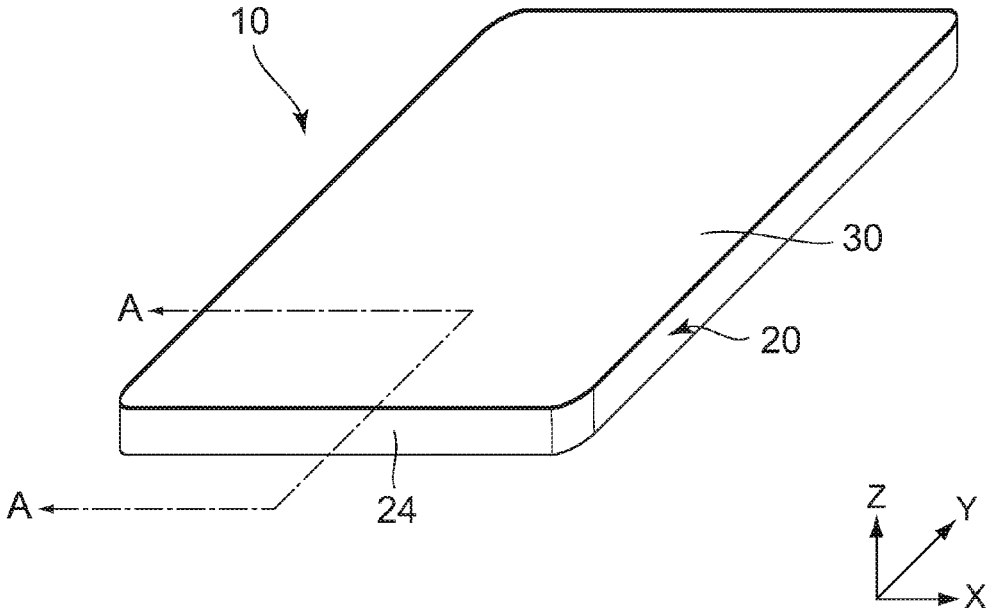
FIG. 1 is a perspective view of a device according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

First Embodiment

Figure 2:
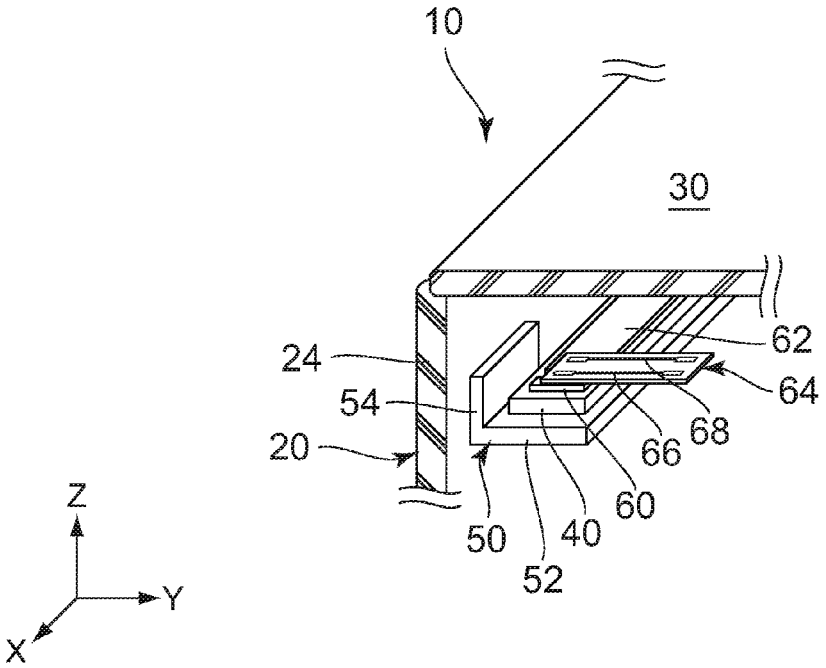
FIG. 2 is a cross-sectional view illustrating a part of the device of FIG. 1, taken along line A-A.

Referring to FIGS. 1 and 2, a device 10 according to a first embodiment of the present invention is provided with a main surface member 30 used as a vibrating plate, a piezoelectric body plate 40, a first support part 50 supporting the piezoelectric body plate 40 and a housing 20. The device 10 of the present embodiment is an electronic device such as a mobile phone, a tablet or a PC while the main surface member 30 is a glass plate constituting a screen of the electronic device, for example. In the present embodiment, the main surface member 30 is disposed to be parallel to a horizontal plane (an XY-plane).

As shown in FIGS. 1 and 2, the housing 20 has a second support part 24 that supports the main surface member 30 and extends in a prescribed direction intersecting the main surface member 30. In the present embodiment, the prescribed direction is a vertical direction (or a Z-direction) perpendicular to the main surface member 30 while the second support part 24 is a side wall portion (or a part supporting the main surface member 30 formed of a glass plate) of the housing 20 of the electronic device. Thus, the housing 20 of the present embodiment is distinct and separated from the main surface member 30.

As illustrated in FIG. 2, on the piezoelectric body plate 40, two external electrodes 60 and 62 are formed. The external electrodes 60 and 62 are supplied with an electric signal (or driving voltage) through conductors 66 and 68 formed on an FPC (Flexible Printed Circuit) 64. The piezoelectric body plate 40 vibrates according to the electric signal supplied. As understood from FIGS. 2 and 3, the piezoelectric body plate 40 has a longitudinal direction in an X-direction and a short-direction in a Y-direction, in the present embodiment. Upon being supplied with the electric signal, the piezoelectric body plate 40 vibrates so that both ends of the piezoelectric body plate 40 in the longitudinal direction are moved in the vertical direction (the Z-direction). In other words, the piezoelectric body plate 40 of the present embodiment carries out bending motion, which is a standing wave having a traveling direction in the longitudinal direction and a maximum amplitude at the both ends in the longitudinal direction, according to the electric signal.

Figure 3:
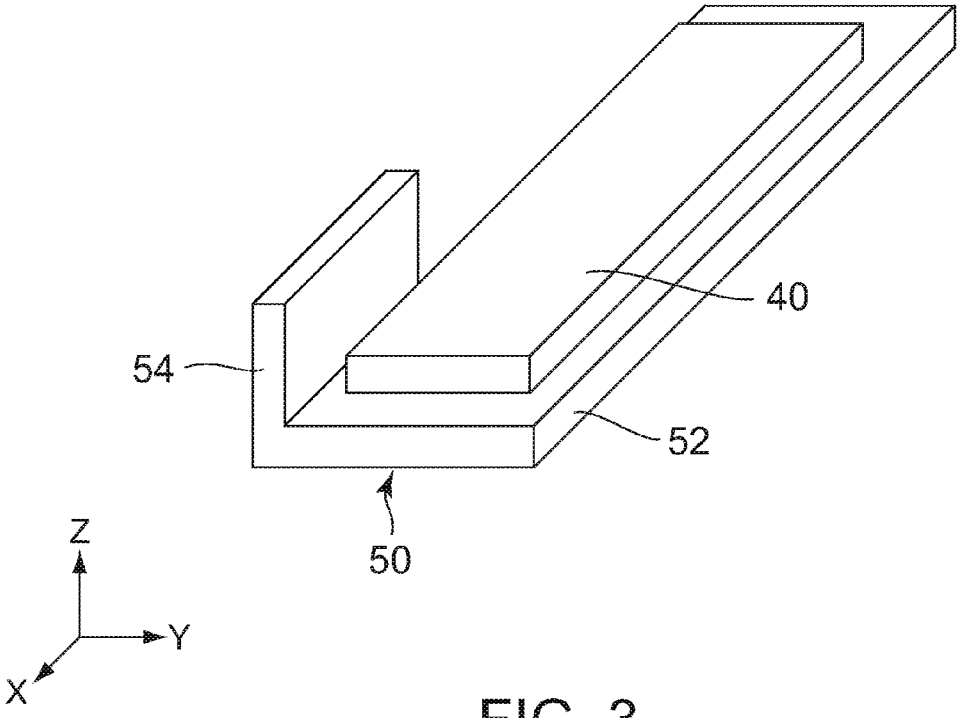
FIG. 3 is a perspective view illustrating a piezoelectric body plate and a first support part which are included in the device of FIG. 2.

As illustrated in FIGS. 2 and 3, the first support part 50 has a plate-like main support part 52 supporting the piezoelectric body plate 40 and a secured part 54 secured to the second support part 24. As with the piezoelectric body plate 40, the main support part 52 has a longitudinal direction in the X-direction and a short-direction in the Y-direction. The secured part 54 is connected to the main support part 52 at a vicinity of one end of the longitudinal direction of the main support part 52. In detail, the secured part 54 is situated at the vicinity of the one end of the longitudinal direction of the main support part 52 and extends in the vertical direction from one end of the short-direction of the main support part 52. Especially, the secured part 54 is provided not to regulate vibration of the main support part 52 in the present embodiment.

The first support part 50 of the present embodiment is made of fiber reinforced plastic. In more specifically, the first support part 50 is made of glass fiber reinforced polyamide resin. The present invention is not limited thereto. The first support part 50 may be formed by bending a metal sheet, for example. Resin, however, is preferable for material of the first support part 50 since it is susceptible of a free shape in comparison with the metal sheet. It is desirable that a thickness (a size in the Z-direction) of the main support part 52 is equal to 0.2 mm or more and 2.0 mm or less from a viewpoint of transmission of the vibration of the piezoelectric body plate 40. Moreover, it is desirable that the first support part 50 is made of an insulator having elastic modules, which is defined by ISO 178, of 7.6 GPa or more and 12.4 GPa or less in the viewpoint of the transmission of the vibration of the piezoelectric body plate 40.

As illustrated in FIG. 2, the secured part 54 of the first support part 50 is secured to the second support part 24. Specifically, the first support part 50 is glued or welded to the second support part 24. As a result of this securing, the second support part 24 vibrates in the vertical direction (the prescribed direction: the Z-direction) and the longitudinal direction (the X-direction) of the piezoelectric body plate 40 according to the bending vibration of the piezoelectric body plate 40. That is, the first support part 50 is secured to the second support part 24 so that the second support part 24 vibrates not only in the vertical direction but in a direction (the X-direction) parallel with the main surface member 30 according to the vibration of the piezoelectric body plate 40. The vibration of the second support part 24 is transmitted to the main surface member 30, and the main surface member 30 vibrates to generate a sound. Thus, in the present embodiment, the main surface member 30 is made to vibrate by transmitting the vibration of the piezoelectric body plate 40 to the main surface member 30 via the first support part 50 and the second support part 24 and thereby generating the sound. Especially, the main surface member 30 vibrates to be applied with torsion repeatedly since the second support part 24 of the present embodiment vibrates in the vertical direction and the longitudinal direction of the piezoelectric body plate 40. As a result, a plurality of resonant points are generated, and the sound having good frequency characteristics can be generated.

In the present embodiment, the first support part 50 supporting the piezoelectric body plate 40 is directly secured to the second support part 24 of the housing 20. A case for accommodating the piezoelectric body plate 40 is not used in the housing 20. Consequently, unlike the cases of Patent Documents 1 and 2, sound pressure is not attenuated by the case for accommodating the piezoelectric body plate 40. Moreover, a space necessary in the housing 20 is small. That is, the device 10 of the present embodiment can obtain sufficient sound pressure even in a case where it is downsized and thinned.

Moreover, according to the present embodiment, since the first support part 50 is secured to the second support part 24 in a state similar to a cantilever, a shock transmitted to the piezoelectric body plate 40 can be reduced even in a case where the shock is added to the housing 20 by falling or the like.

Figure 4:
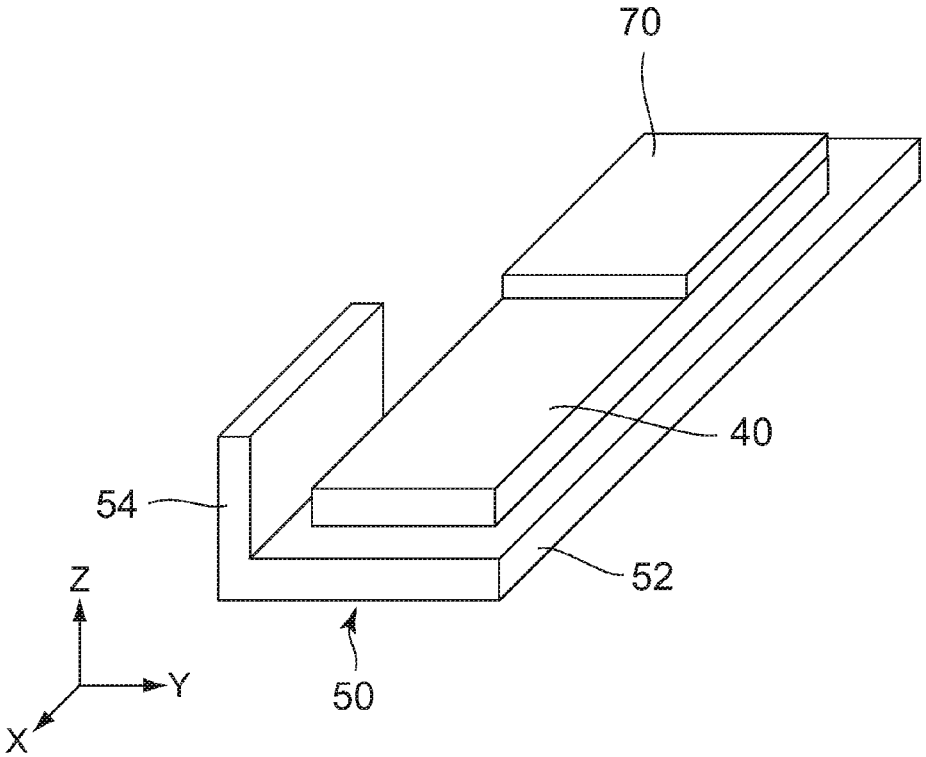
FIG. 4 is a perspective view illustrating a modification of the piezoelectric body plate and the first support part of FIG. 2.
Figure 5:
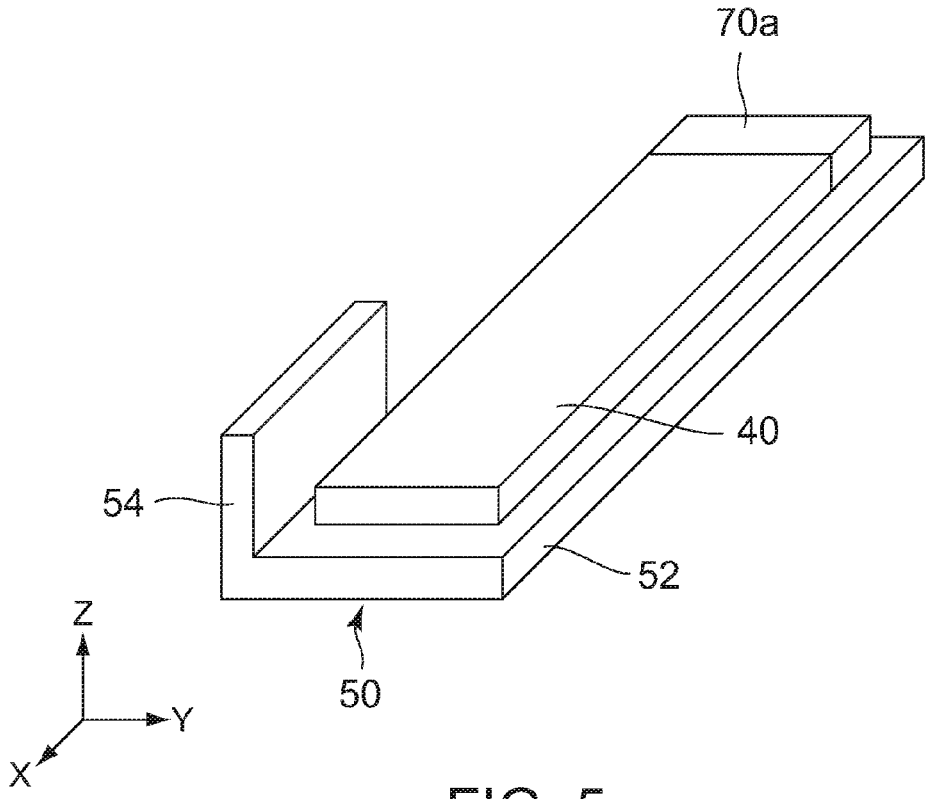
FIG. 5 is a perspective view illustrating another modification of the piezoelectric body plate and the first support part of FIG. 2.

In the embodiment mentioned above, a weight 70 secured to the piezoelectric body plate 40 may be further provided as illustrated in FIG. 4 or a weight 70*a* secured to the first support part 50 may be further provided as illustrated in FIG. 5. If the weight 70 or 70*a* is provided, frequency characteristics of the sound pressure can be adjusted according to a secured position of the weight 70 or 70*a*. Though the number of the weights 70 and 70*a* illustrated in FIGS. 4 and 5 are one each, the number of the weight 70 or 70*a* may be two or more.

Second Embodiment

A device according to a second embodiment of the present invention is a modification of the device 10 according to the first embodiment illustrated in FIGS. 1 and 2 and is provided with a similar configuration except for the configuration of the first support part and the securing structure against the second support part. Accordingly, the description will be made about the first support in detail in the following.

Figure 6:
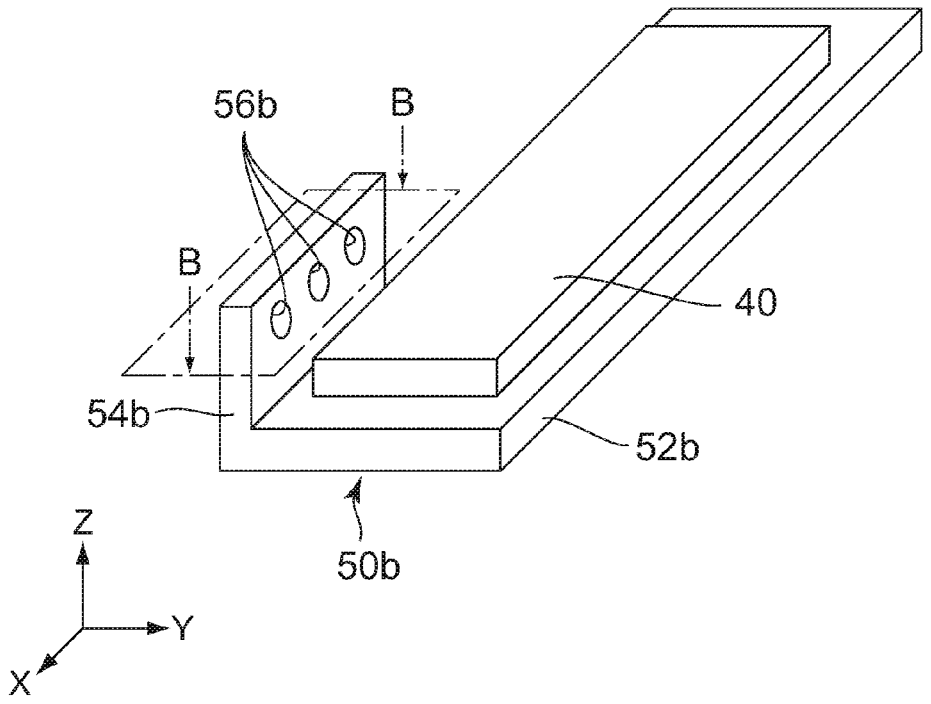
FIG. 6 is a perspective view illustrating a piezoelectric body plate and a first support part which are included in a device according to a second embodiment of the present invention.
Figure 7:
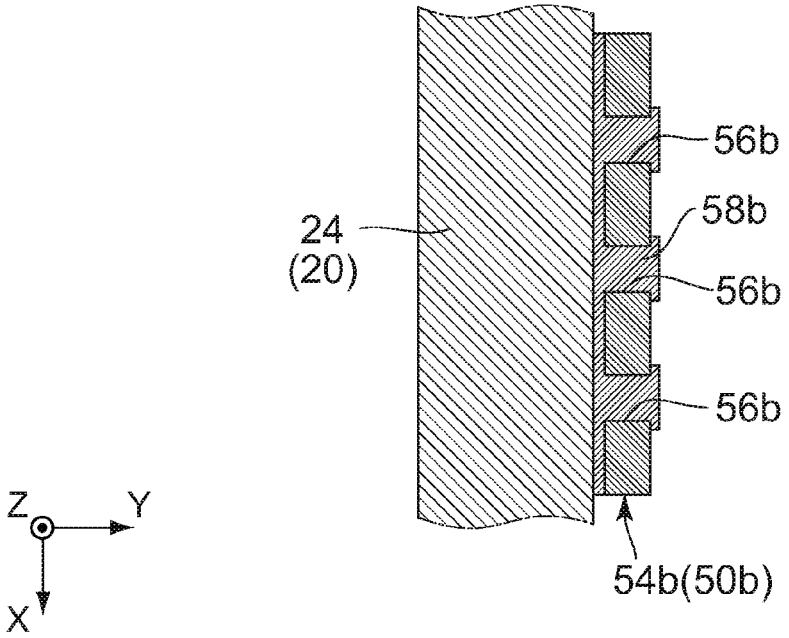
FIG. 7 is a cross-sectional view illustrating a state where a secured part of the first support part of FIG. 6 is secured to a second support part, taken along line B-B.

Referring to FIGS. 6 and 7, a first support part 50*b* according to the present embodiment has a main support part 52*b* and a secured part 54*b*. As illustrated in FIG. 6, the main support part 52*b* has a plate-like shape and supports the piezoelectric body plate 40. As with the piezoelectric body plate 40, the main support part 52*b* has a longitudinal direction in the X-direction and a short-direction in the Y direction. The secured part 54*b* is connected to the main support part 52*b* at a vicinity of one end of the longitudinal direction of the main support part 52*b*. In detail, the secured part 54*b* is situated at the vicinity of the one end of the longitudinal direction of the main support part 52*b* and extends in the vertical direction from one end of the short-direction of the main support part 52*b*.

As illustrated in FIGS. 6 and 7, a plurality of through holes 56*b* are formed in the secured part 54*b*. As illustrated in FIG. 7, the secured part 54*b* is secured to the second support part 24 using an adhesive 58*b*. With this securing, in the same way as a case of the first embodiment mentioned above, the vibration of the piezoelectric body plate 40 can be transmitted to the main surface member 30 (see FIG. 1).

Furthermore, in a case where the through holes 56*b* are formed in the secured part 54*b* as in the present embodiment, the adhesive 58*b* is filled in the through holes 56*b* as illustrated in FIG. 7 when the secured part 54*b* is glued and secured to the second support part 24 using the adhesive 58*b*. Thus adhesion area between the adhesive 58*b* and the secured part 54*b* can be enlarged, and securing strength of the secured part 54*b* against the second support part 24 can be increased. To obtain similar effect, grooves reaching an upper end (a positive Z side end) of the secured part 54*b* or grooves reaching a side end (a positive X side end or a negative X side end) of the secured part 54*b* may be formed in place of the through holes 56*b*.

Third Embodiment

A device according to a third embodiment of the present invention is a modification of the device 10 according to the first embodiment illustrated in FIGS. 1 and 2 and is provided with a similar configuration except for the configuration of the first support part and the securing structure of the second support part. Accordingly, the description will be made about the first support part in detail in the following.

Figure 8:
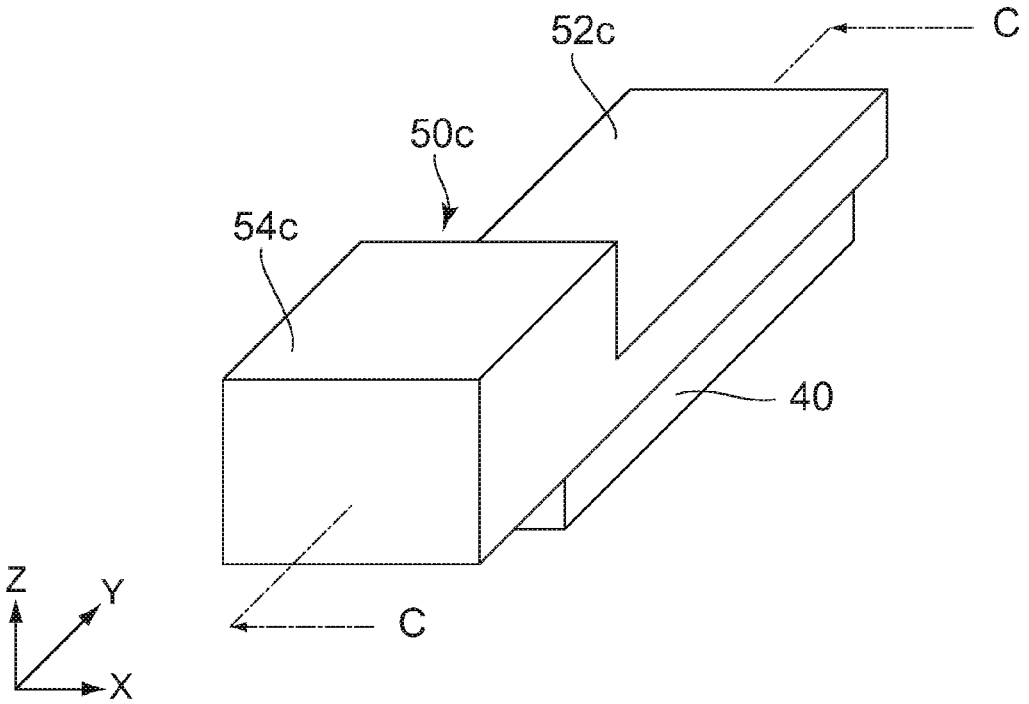
FIG. 8 is a perspective view illustrating a piezoelectric body plate and a first support part which are included in a device according to a third embodiment of the present invention.
Figure 9:
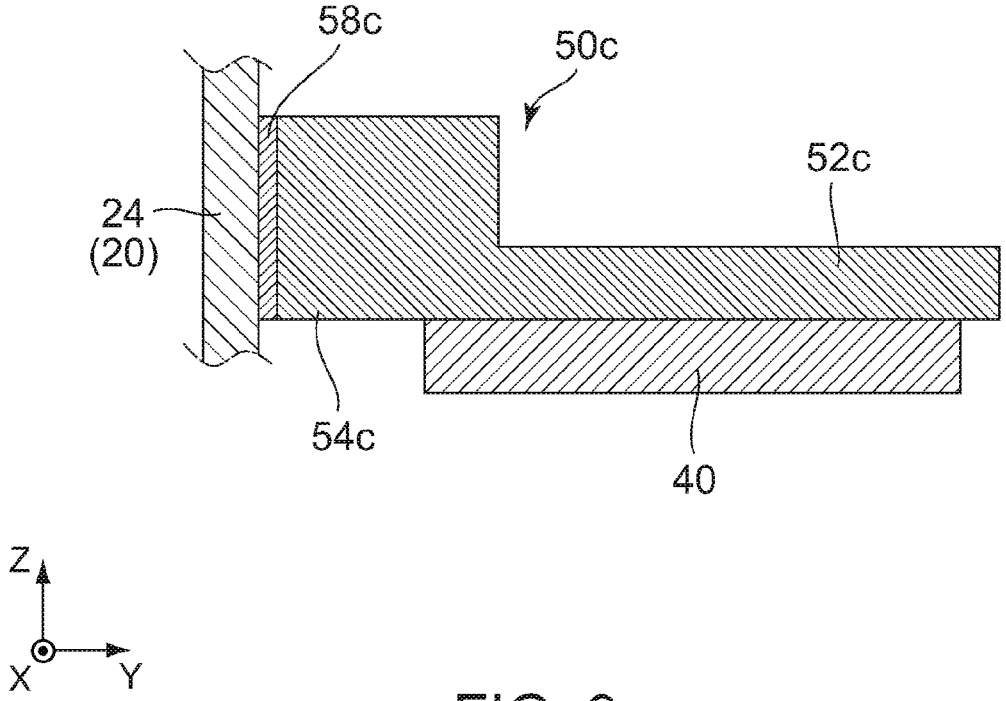
FIG. 9 is a cross-sectional view illustrating a state where a secured part of the first support part of FIG. 8 is secured to a second support part, taken along line C-C.

Referring to FIGS. 8 and 9, a first support part 50*c* according to the present embodiment has a main support part 52*c* and a secured part 54*c*. The main support part 52*c* has a plate-like shape and supports the piezoelectric body plate 40. As with the piezoelectric body plate 40, the main support part 52*c* has a longitudinal direction in the X-direction and a short-direction in the Y-direction. The secured part 54*c* has a block shape and is connected to the main support part 52*c* at one end of the longitudinal direction of the main support part 52*c*. In detail, the secured part 54*c* is situated at the one end of the longitudinal direction of the main support part 52*c* and is in a line with the main support part 52*c* in the longitudinal direction of the main support part 52*c*.

As illustrated in FIG. 9, the secured part 54*c* is glued and secured to the second support part 24 in the longitudinal direction of the main support part 52*c* using adhesive 58*c*. Since the secured part 54*c* is secured to the second support part 24 in this manner, the second support part 24 vibrates in the vertical direction (the prescribed direction) according to the vibration of the piezoelectric body plate 40, and due to this the main surface member 30 (see FIG. 1) vibrates to allow to generate a sound.

Fourth Embodiment

A device according to a fourth embodiment of the present invention is a modification of the device 10 according to the first embodiment illustrated in FIGS. 1 and 2 and is provided with a similar configuration except for the configuration of the first support part and the securing structure against the second support part. Accordingly, the description will be made about the first support part in detail in the following.

Figure 10:
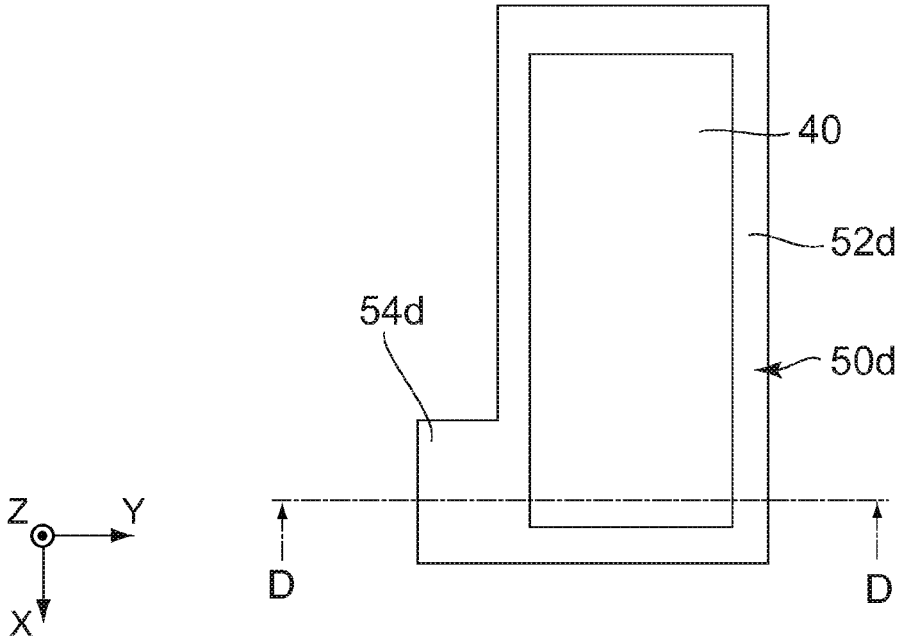
FIG. 10 is a top view of a piezoelectric body plate and a first support part which are included in a device according a fourth embodiment of the present invention.
Figure 11:
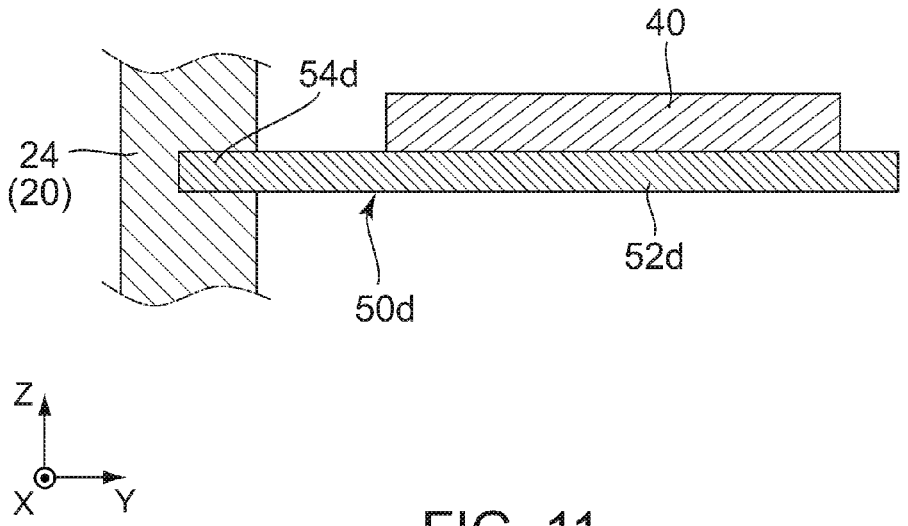
FIG. 11 is a cross-sectional view illustrating a state where a secured part of the first support part of FIG. 10 is secured to a second support part, taken along line D-D.

Referring to FIGS. 10 and 11, a first support part 50*d* according to the present embodiment has a main support part 52*d* and a secured part 54*d*. As illustrated in FIG. 10, the main support part 52*d* has a plate-like shape and supports the piezoelectric body plate 40. As with the piezoelectric body plate 40, the main support part 52*d* has a longitudinal direction in the X-direction and a short-direction in the Y-direction. The secured part 54*d* is connected to the main support part 52*d* at a vicinity of one end of the longitudinal direction of the main support part 52*d*. In detail, the secured part 54*d* is situated in a vicinity of the one end of the longitudinal direction of the main support part 52*d* and extends on a plane (a X-Y plane) same as the main support part 52*d* from one end of the short-direction of the main support part 52*d*.

As illustrated in FIG. 11, the secured part 54*d* is fit into and secured to the second support part 24. Securing means may be gluing or welding, for example. With this securing, in the same way as the case of the first embodiment mentioned above, the vibration of the piezoelectric body plate 40 can be transmitted to the main surface member 30 (see FIG. 1).

Fifth Embodiment

A device according to a fifth embodiment of the present invention is a modification of the device 10 according to the first embodiment illustrated in FIGS. 1 and 2 and is provided with a similar configuration except for the configuration of the first support part and the securing structure against the second support part. Accordingly, the description will be made about the first support part in detail in the following.

Figure 12:
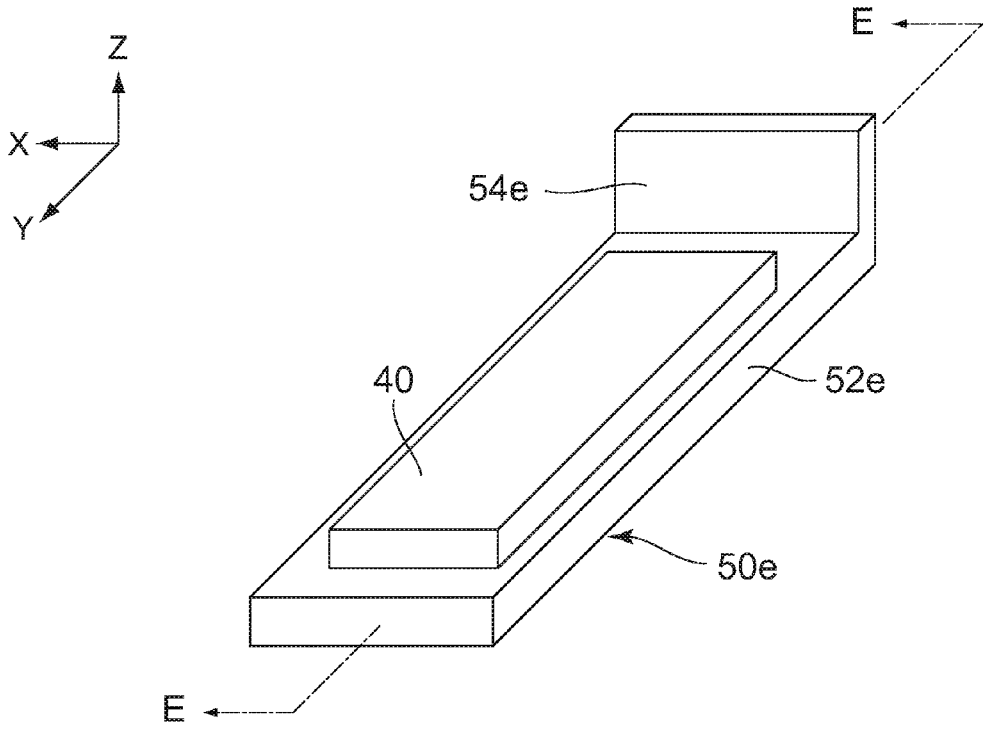
FIG. 12 is a perspective view of a piezoelectric body plate and a first support part which are included in a device according to a fifth embodiment of the present invention.
Figure 13:
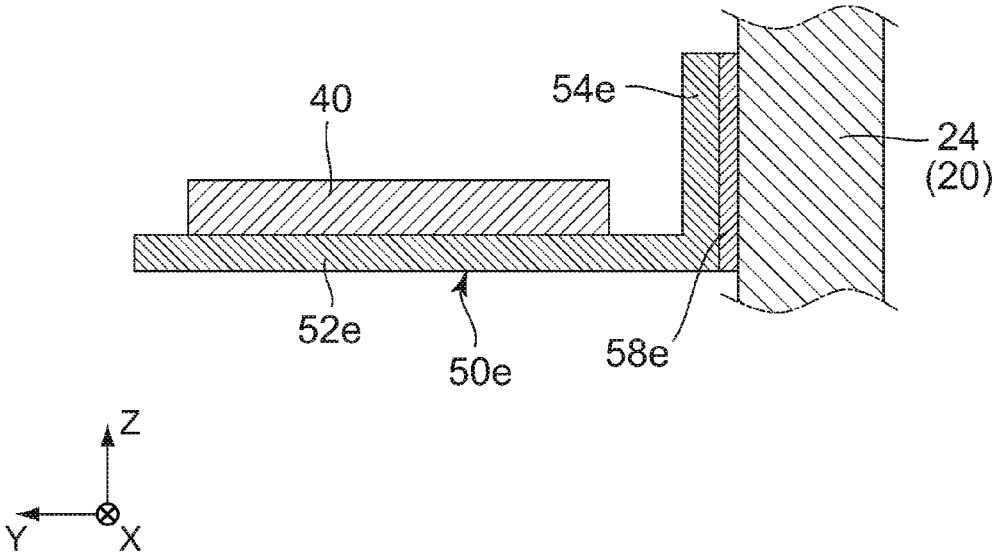
FIG. 13 is a cross-sectional view illustrating a state where a secured part of the first support part of FIG. 12 is secured to a second support part, taken along line E-E.

Referring to FIGS. 12 and 13, a first support part 50*e* according to the present embodiment has a main support part 52*e* and a secured part 54*e*. The main support part 52*e* has a plate-like shape and supports the piezoelectric body plate 40. As with the piezoelectric body plate 40, the main support part 52*e* has a longitudinal direction in the X-direction and a short-direction in the Y-direction. The secured part 54*e* is connected to the main support part 52*e* at one end of the longitudinal direction of the main support part 52*e*. In detail, the secured part 54*e* extends in the vertical direction (the prescribed direction) from the one end of the longitudinal direction of the main support part 52*e*.

As illustrated in FIG. 13, the secured part 54*e* is glued and secured to the second support part 24 using an adhesive 58*e* in the longitudinal direction of the main support part 52*c*. Since the secured part 54*e* is secured to the second support part 24 in this manner, the second support part 24 vibrates in the vertical direction (the prescribed direction) according to the vibration of the piezoelectric body plate 40, and due to this the main surface member 30 (see FIG. 1) vibrates to allow to generate a sound.

Sixth Embodiment

A device according to a sixth embodiment of the present invention is a modification of the device 10 according to the first embodiment illustrated in FIGS. 1 and 2 and is provided with a similar configuration except for the configuration of the first support part and the securing structure against the second support part. Accordingly, the description will be made about the first support part in detail in the following.

Figure 14:
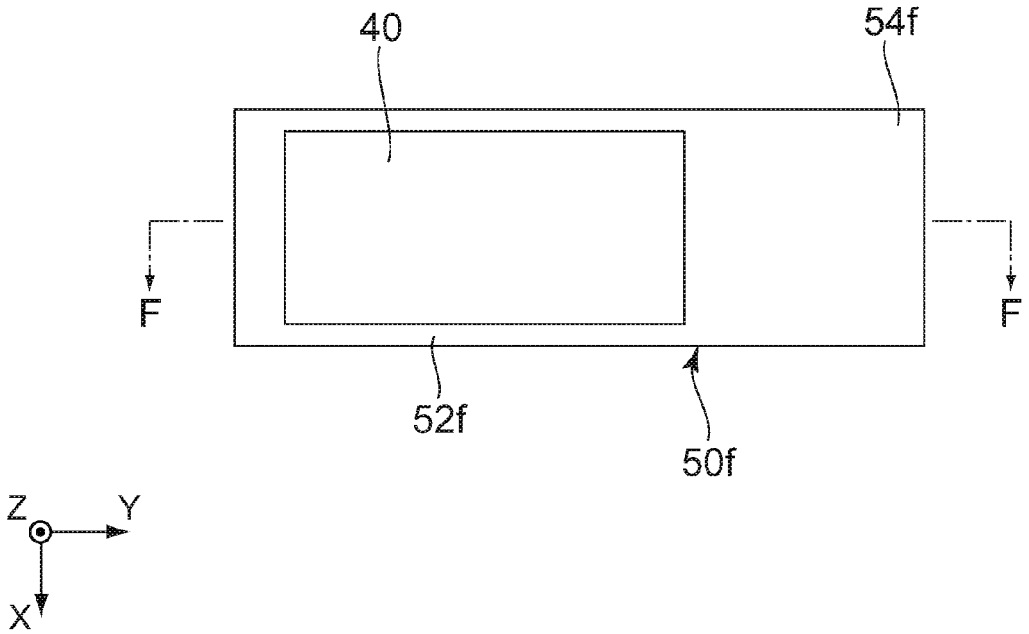
FIG. 14 is a top view of a piezoelectric body plate and a first support part which are included in a device according a sixth embodiment of the present invention.
Figure 15:
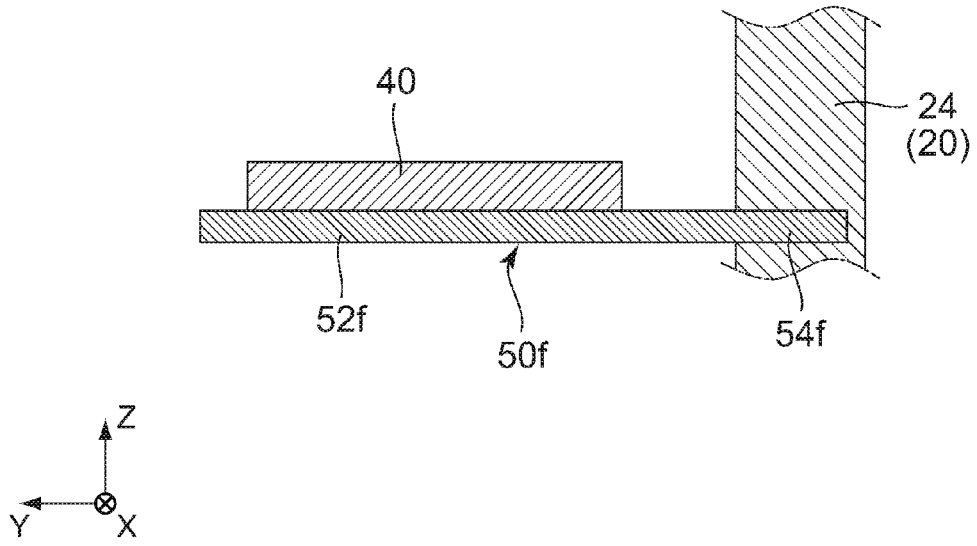
FIG. 15 is a cross-sectional view illustrating a state where a secured part of the first support part of FIG. 14 is secured to a second support part, taken along line F-F.

Referring to FIGS. 14 and 15, a first support part 50*f* according to the present embodiment has a main support part 52*f* and a secured part 54*f*. The main support part 52*f* has a plate-like shape and supports the piezoelectric body plate 40. As with the piezoelectric body plate 40, the main support part 52*f* has a longitudinal direction in the X-direction and a short-direction in the Y-direction. The secured part 54*f* is connected to the main support part 52*f* at one end of the longitudinal direction of the main support part 52*f*. In detail, the secured part 54*f* extends on a plane (the X-Y plane) same as the main support part 52*f* from the one end of the longitudinal direction of the main support part 52*f*. That is, the main support part 52*f* and the secured part 54*f* are lined in the longitudinal direction (the X-direction) of the main support part 521.

As illustrated in FIG. 15, the secured part 54*f* is fit into and secured to the second support part 24. Securing means may be gluing or welding, for example. With this securing, the second support part 24 vibrates in the vertical direction (the prescribed direction) according to the vibration of the piezoelectric body plate 40, and due to this the main surface member 30 (see FIG. 1) vibrates to allow to generate a sound.

Although the specific explanation about the present invention is made above referring to the embodiments, the present invention is not limited thereto. Although the first support part 50, 50*b*, 50*c*, 50*d*, 50*e* or 50*f* is illustrated to be distinct and separated from the second support part 24, the present invention is not limited thereto. The first support part 50, 50*b*, 50*c*, 50*d*, 50*e* or 50*f* may be made of a material identical to the second support part 24 and integrally molded. In such a case, the secured part 54, 54*b*, 54*c*, 54*d*, 54*e* or 54*f* may be a part of the second support part 24.

EXAMPLES

Examples 1 and 2 provided with the structure (see FIGS. 1 to 3) of the first embodiment mentioned above have been manufactured. A first support part 50 of the first example is made of stainless steel and has a main support part 52 with 13.0 mm length, 4.5 mm width and 1.0 mm thickness and a secured part 54 with 6.0 mm width, 3.0 mm height and 1.0 mm thickness. A first support part 50 of the second example is made of glass-fiber-reinforced polyamide resin and has a size same as the example 1.

Figure 16:
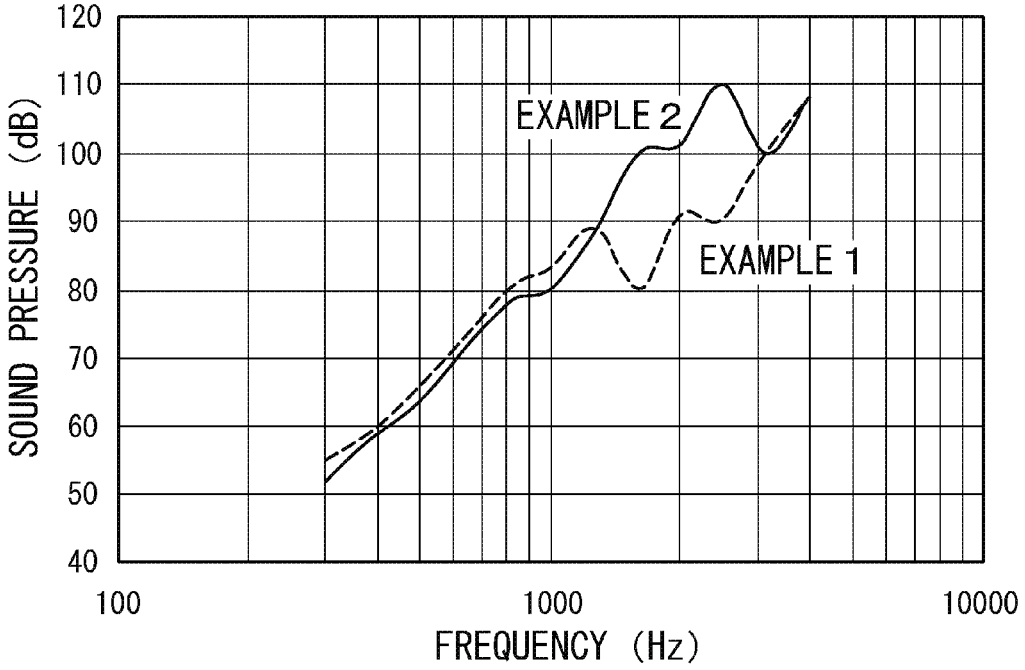
FIG. 16 is a diagram illustrating frequency characteristics of sound pressures of sounds generated by devices according to embodiments of the present invention.

FIG. 16 illustrates frequency characteristics of sound pressures of sounds generated in the devices 10 which are provided with the first support parts 50 of the example 1 and the example 2.

Referring to FIG. 16, the sound generated by the example 1 has been able to obtain enough sound pressure even if a frequency is over 3.3 kHz which is the upper limit of audible area. Furthermore, the sound generated by the example 2 has exceeded the sound pressure of the example 1 when it has a frequency of about 1 kHz to 3 kHz.

The present invention is based on Japanese Patent Applications Nos. 2013-223431 and 2014-161510 filed on Oct. 28, 2013 and Aug. 7, 2014, respectively, and the contents of which form a part of the present specification by reference.

While the best embodiments of the present invention have been described, as it is apparent to those skilled in the art, the embodiments are possible to be modified within a scope that is not departing from the spirit of the present invention, and such embodiments belong to the scope of the present invention.

REFERENCE SIGNS LIST

10 device
20 housing
24 second support part
30 main surface member (glass plate: vibration plate)
40 piezoelectric body plate
50, 50*b*, 50*c*, 50*d*, 50*e*, 50*f* first support part
52, 52*b*, 52*c*, 52*d*, 52*e*, 52*f* main support part
54, 54*b*, 54*c*, 54*d*, 54*e*, 54*f* secured part
56*b* through hole
58*b*, 58*c*, 58*e* adhesive
60, 62 external electrode
64 FPC
66, 68 conductor
70, 70*a*→weight

The invention claimed is:

1. A device comprising:

a main surface member used as a vibration plate;

a piezoelectric body plate that vibrates according to an electric signal;

a first support part supporting the piezoelectric body plate; and a housing, wherein:

the housing has a second support part supporting the main surface member and extending in a prescribed direction intersecting the main surface member, the first support part is secured to the second support part so that the second support part vibrates in the prescribed direction according to vibration of the piezoelectric body plate, the vibration of the piezoelectric body plate is transmitted to the main surface member via the first support part and the second support part, thereby making the main surface member vibrate to generate a sound, the first support part has a plate-like main support part supporting the piezoelectric body plate and a secured part secured to the second support part, the main support part extends in a longitudinal direction intersecting the prescribed direction, and the secured part is connected to the main support part at one end or a vicinity of the one end of the main support part in the longitudinal direction.

2. The device recited in claim 1, wherein the first support part is secured to the second support part so that the second support part vibrates in any direction parallel to the main surface member according to the vibration of the piezoelectric body plate.

3. The device recited in claim 1, wherein a thickness of the main support part is at least 0.2 mm and at most 2.0 mm.

4. The device recited in claim 1, wherein the first support part is glued or welded to the second support part.

5. The device recited in claim 1, wherein the first support part is made of a material identical to a material of the second support part, and the first support part and the second support part are integrally molded.

6. The device recited in claim 1, wherein the first support part is made of an insulator having elastic modules, which are defined by ISO 178, of at least 7.6 GPa and at most 12.4 GPa.

7. The device recited in claim 1, wherein the first support part is made of fiber reinforced plastic.

8. The device recited in claim 7, wherein the fiber reinforced plastic is glass fiber reinforced polyamide resin.

9. The device recited in claim 1, further comprising a weight provided on the piezoelectric body plate or the first support part.

10. The device recited in claim 1, wherein the housing is distinct and separated from the main surface member.

11. The device recited in claim 1, wherein the secured part extends in the prescribed direction.

12. The device recited in claim 1, wherein the second support part is a side wall portion of the housing.

13. The device recited in claim 1, wherein a plurality of through holes are formed in the secured part, and the secured part is secured to the second support part by an adhesive.

14. The device recited in claim 1, wherein the secured part has a block shape.

15. The device recited in claim 1, wherein the secured part is fit into and secured to the second support part.

* * * * *